United States Patent [19]

Murakami et al.

[11] Patent Number: 5,005,746

[45] Date of Patent: Apr. 9, 1991

[54] APPARATUS FOR FEEDING BOTH CUT SHEET AND FAN FOLD PAPER IN A PRINTER

[75] Inventors: Kenjiro Murakami; Hirokazu Iinuma; Toshikazu Kodaka, all of Suwa, Japan

[73] Assignee: Seiko Epson Corporation, Tokyo, Japan

[21] Appl. No.: 333,166

[22] Filed: Apr. 4, 1989

[30] Foreign Application Priority Data

Apr. 8, 1988 [JP] Japan ..... 63-87009

[51] Int. Cl.[5] ..... B41J 13/00; B65M 17/10

[52] U.S. Cl. ..... 226/101; 226/187; 400/605; 400/636

[58] Field of Search ..... 226/101, 108, 111, 186, 226/187; 400/613.2, 618, 636, 605

[56] References Cited

U.S. PATENT DOCUMENTS 767,640 8/1904 Fredenburgh ..... 226/187
3,037,090 5/1962 Bouzemburg ..... 226/187 X
3,112,052 11/1963 Johnson ..... 226/108 X
3,964,739 6/1976 Garcia ..... 226/187 X
4,834,277 5/1989 Gomoll et al. ..... 400/605

FOREIGN PATENT DOCUMENTS 0056577 4/1985 Japan ..... 400/605

*Primary Examiner*—Daniel P. Stodola
*Assistant Examiner*—Paul Thomas Bowen
*Attorney, Agent, or Firm*—Blum Kaplan

[57] ABSTRACT

An apparatus for feeding paper in a printer adapted to utilize both fan fold paper and cut sheet paper includes a push tractor for feeding fan fold paper. A print head is positioned downstream of the push tractor along the paper path. A paper feed roller is positioned intermediate the push tractor and the print head. The feed roller selectively feeds paper towards the print head. A discharge roller is positioned downstream of the print head for feeding paper. The apparatus detecting the type of paper being fed and varying the pressure utilized by the feed roller to feed the paper in response thereto.

15 Claims, 5 Drawing Sheets

APPARATUS FOR FEEDING BOTH CUT SHEET AND FAN FOLD PAPER IN A PRINTER

BACKGROUND OF THE INVENTION

The present invention relates to an apparatus for feeding both cut-sheet and fan fold sheet paper within a printer, and in particular to preventing the slack formed in paper fed in a printer.

A conventional paper feeding apparatus as shown in FIG. 1 includes a print head 106. A push tractor 101 feeds fan fold paper 102 downstream in the direction of arrow G to print head 106. A pair of feed rollers 103 are positioned on the downstream side of print head 106. Cut sheet paper is fed by feed rollers positioned upstream of print head 106 in conjunction with feed rollers 103.

The conventional paper feeding apparatus has been satisfactory. However, there is a large space between push tractor 101 and feed rollers 103 to allow for feeding a cut sheet to print head 106. Therefor, when fan fold sheet 102 is fed by push tractor 101, as fan fold paper 102 travels in the direction of arrow G toward feed rollers 103 slack is likely to occur in the paper. This results from the fact that the paper travels such a large distance unsupported. This slack does not become removed until fan fold paper 102 has been fed for several lines to as many as ten lines after the leading edge of fan fold paper 102 has reached feed rollers 103. Because the paper feed rate fluctuates due to the slack, the printing dot produced on the paper by print head 106 cannot be located accurately on fan fold paper 102 during this slack and slack recovery period. As a result, high precision printing cannot be guaranteed.

Accordingly, it is desired to provide a paper feeding apparatus which overcomes the disadvantages of the prior art device described above by providing an intermediate paper feeding structure to eliminate slack during the feeding of fan fold paper.

SUMMARY OF THE INVENTION

Generally speaking, in accordance with the present invention, an apparatus for feeding paper within a printer adapted to utilize both fan fold and cut sheet paper is provided. The apparatus for feeding paper includes a push tractor for feeding fan fold paper. A print head is positioned downstream in the paper feeding direction from the push tractor. A first feed roller is disposed intermediate the push tractor and the print head for feeding both cut sheet paper and fan fold paper towards the print head. The first feed roller applies a variable pressure to the paper to be fed. A second feed roller is located downstream in the paper feeding direction from the print head for feeding the paper. The first feed roller feeds the paper until the paper has reached the second feed roller. The first feed roller then disengages from the paper to allow feeding by the second feed roller when fan fold paper is being used.

When a cut sheet is being fed through the apparatus, the first feed roller does not disengage when the second feed roller engages the paper. Additionally, a greater pressure is applied by the first feed roller when cut sheet paper is being fed.

Accordingly, it is an object of this invention to provide an improved apparatus for feeding both fan fold and cut sheet paper within a printer.

Another object of this invention is to provide an apparatus for feeding fan fold paper within a printer in which print dots may be placed on the paper with high precision by enhancing the sheet feed precision.

Yet another object of the invention is to provide an apparatus for feeding fan sheet paper in a printer adapted to use both fan fold and cut sheet paper which eliminates slack when feeding fan fold paper.

Still other objects and advantages of the invention will in part be obvious and will in part be apparent from the specification and drawings.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
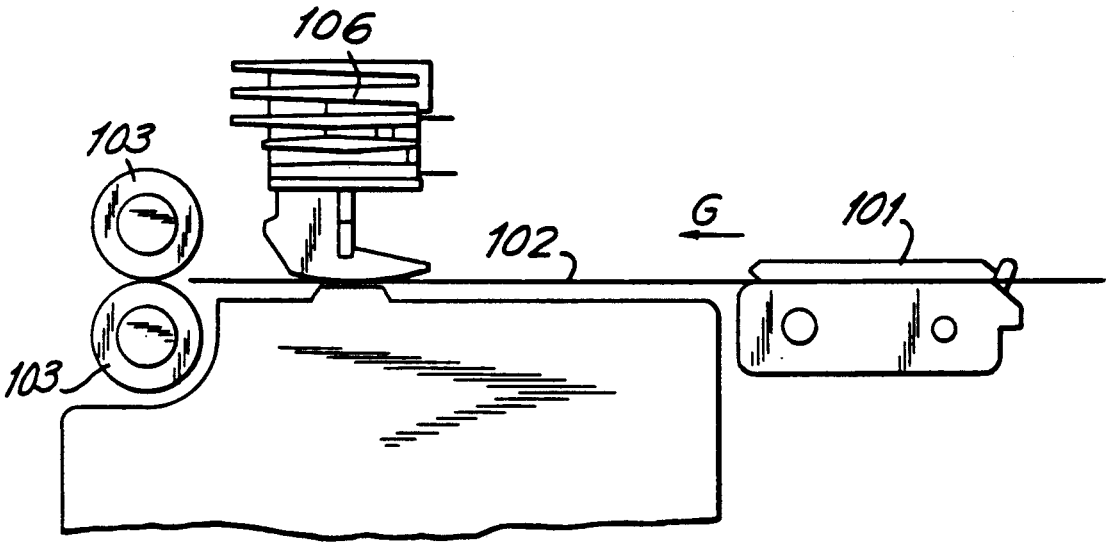
FIG. 1 PRIOR ART
FIG. 1 is a side elevational view of an apparatus for feeding fan fold and cut sheet paper constructed in accordance with the prior art.
Figure 2:
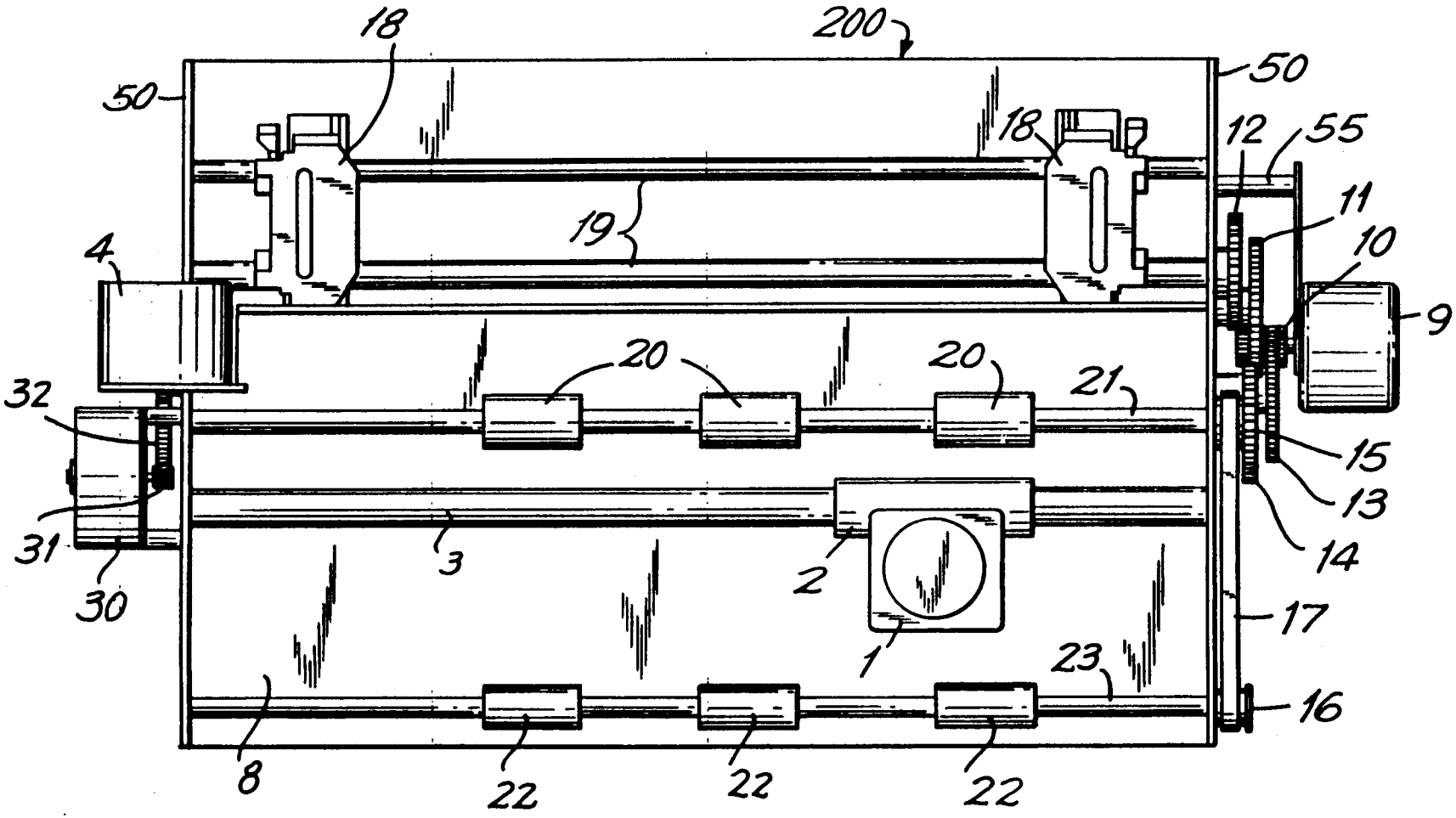
FIG. 2 is a top plan view of an apparatus for feeding fan fold paper and cut sheet paper in a printer constructed in accordance with the invention.

Reference is first made to FIG. 2, wherein an apparatus for feeding paper in a printer adapted to utilize both cut sheet and feed paper, generally indicated at 200, and constructed in accordance with the present invention, is depicted. Apparatus 200 includes a frame 50. A guide shaft 3 is mounted on frame 50. A carriage 2 is slideably mounted on guide shaft 3 and a print head 1 is mounted on carriage 2. A motor 4 mechanically coupled to carriage 2 moves carriage 2 along guide shaft 3 in a printing direction. A platen 8 is supported on frame 50 within the paper path.

A pair of push tractors 18 include pins which engage perforations provided on opposite edges of fan fold paper 7. Push tractors 18 are positioned upstream of printing head 1 in the paper path. A motor 9 is mounted on frame 50 by supports 55. A first gear 10 is rotated by motor 9. A second gear 11 engages gear 10 and a gear 12 so that motor 9 causes gear 12 to rotate. Gear 12 is coupled to the lower (FIG. 2) or downstream of tractor shafts 19 for driving push tractors 18. Tractor shafts 19 are rotatably supported on frame 50. Tractors 18 are mounted on tractor shafts 19, are axially shiftable relative to tractor shafts 19 and the sprocket belts (not shown) thereof rotate with tractor shafts 19.

A feed roller shaft 21 is mounted on frame 50 substantially parallel to guide shaft 3. First feed rollers 20 are mounted on feed shaft 21 and are disposed within the paper feed path intermediate print head 1 and tractors 18. A gear 13 is coupled to gear 10 and a gear 14. Gear 14 is coupled to feed shaft 21 so that feed shaft 21 is also rotated by motor 9.

A discharge roller shaft 23 is mounted on frame 50 within the paper feed path downstream of print head 1.

Discharge rollers 22 are mounted on discharge roller shaft 23. A belt pulley 16 is affixed to discharge roller shaft 23. A belt pulley 15 is integrally formed with gear 14 affixed to feed shaft 21. Belt pulley 15 is coupled to belt pulley 16 by a timing belt 17 so that discharge roller 23 is simultaneously rotated with gear 14.

Figure 3A:
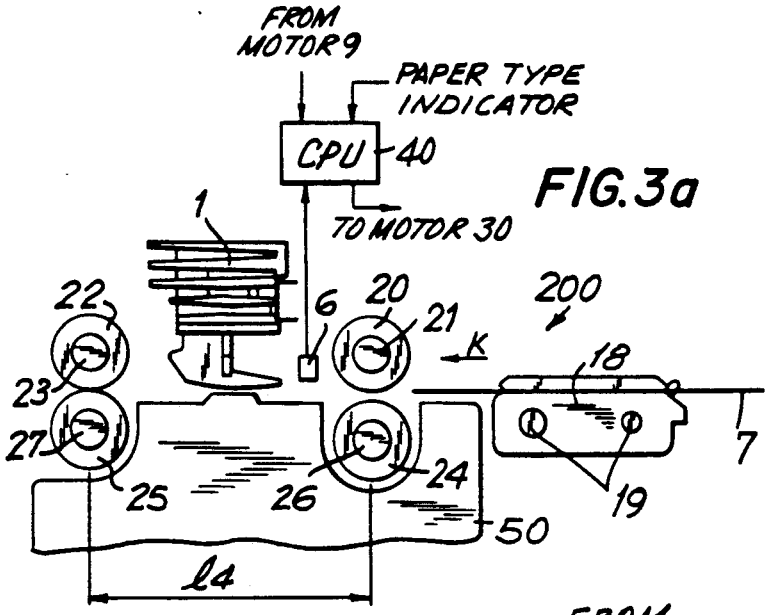
FIGS. 3*a*–3*e* are schematic views of the operation of the apparatus for feeding paper constructed in accordance with the invention.

Reference is now made to FIG. 3*a* in which a side elevational view of apparatus 200 is provided. A shaft 26 is mounted below the paper path parallel to feed roller 20. A pressure roller 24 for acting in cooperation with feed roller 20 is mounted on shaft 26. Pressure roller 24 selectively comes in pressure contact with feed roller 20. Similarly, a shaft 27 is supported on frame 50 below the paper feed path parallel to discharge rollers 22. A pressure roller 25 for coming in contact with discharge rollers 22 is provided. Pressure rollers 24, 25 are rotatably journaled on shafts 26, 27 respectively and therefor rotate when fan fold paper 7 is forwarded past pressure rollers 24, 25.

Pressure roller 24 may be moved in three stages towards feed roller 20 and is thus positionable in accordance with the desired pressure corresponding to the type of paper being fed. A detector 6 is provided downstream of pressure roller 24 and upstream of print head 1. Detector 6 recognizes the leading edge of fan fold paper 7 as well as the position of the leading edge and detects the trailing edge of the paper being fed.

Figure 3B:
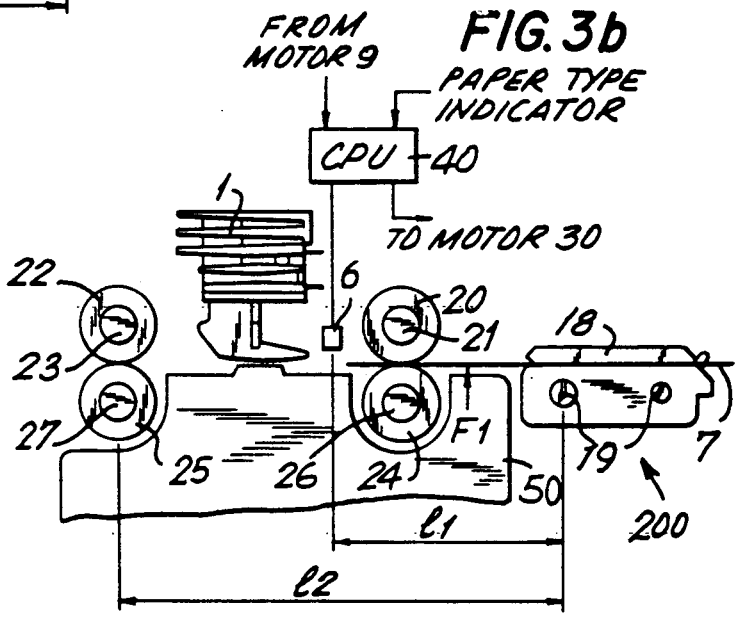
Figure 3C:
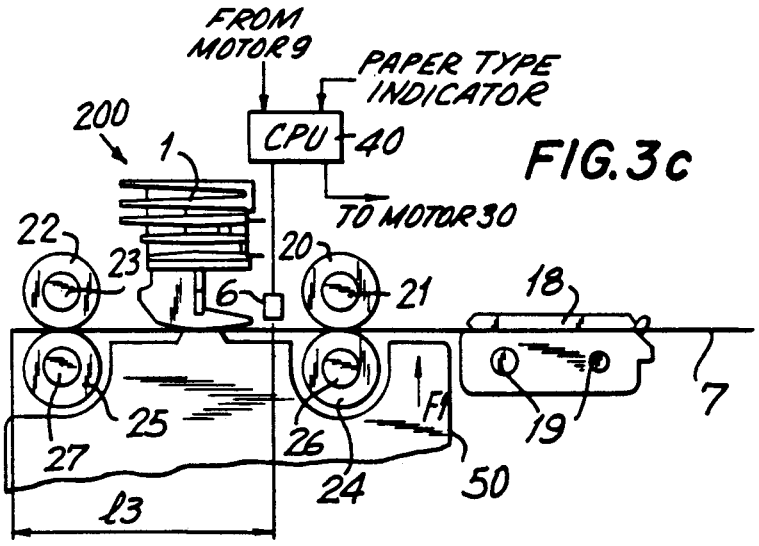
Figure 4A:
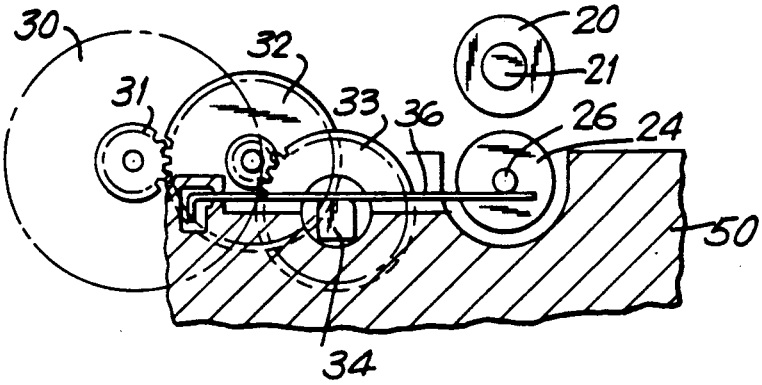
FIGS. 4*a*–4*c* are schematic views of the gear structure for shifting the first feed roller constructed in accordance with the invention.
Figure 4B:
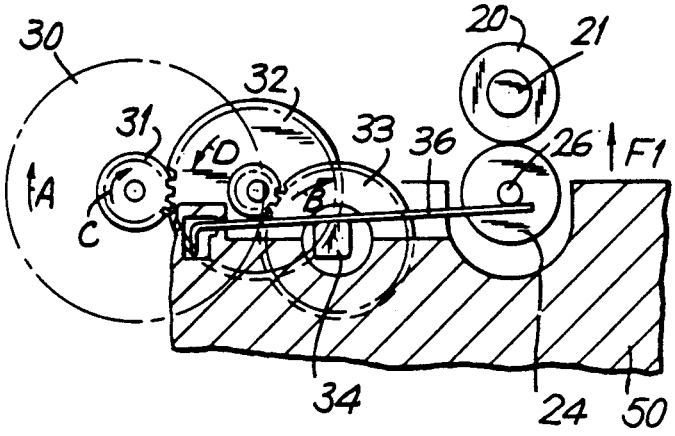
Figure 4C:
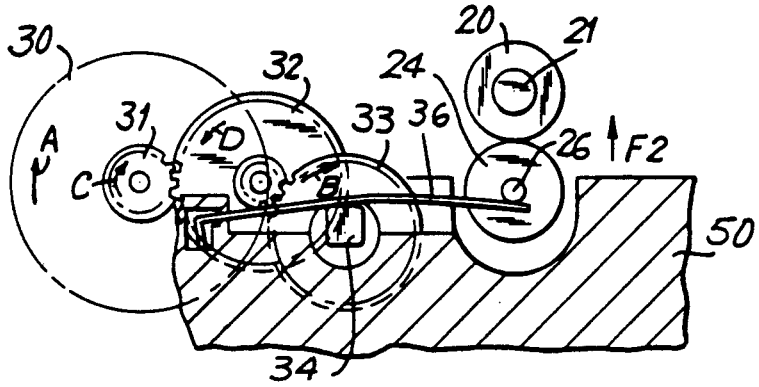

Reference is now made to FIGS. 4*a*–4*c* wherein the movement of pressure roller 24 is depicted A step motor 30 supported on frame 50 is coupled to a gear 31. A gear 32 meshes with a gear 31 and gear 33. A square shaft 34 is disposed eccentrically on gear 33. A leaf spring 36 extends across square shaft 34 and beneath rotatable shaft 26. As seen in FIG. 4*a*, square shaft 34 is supported at one end on frame 50, the other end being free. At the position depicted in FIG. 4*a* of square shaft 34 does not come in contact with leaf spring 36. Accordingly, leaf spring 36 acts only to bear the weight of pressure roller 24 at a distance from feed roller 20. In this position, feed roller 20 and pressure roller 24 do not exert an influence on paper passing therebetween. When motor 30 rotates in the direction indicated by arrow A as seen in FIG. 3*b*, gear 31 rotates in the direction indicated by arrow C, gear 32 rotates in the direction indicated by arrow D causing gear 33 and square shaft 34 to rotate in the direction indicated by arrow B. Because square shaft 34 is disposed eccentrically on gear 33, leaf spring 36 is forced upward by square shaft 34 and is rotated about its free end shifting pressure roller 24 in the direction indicated by arrow $F_1$. In this position, pressure roller 24 exerts a moderate pressure against feed roller 20, preventing the pressure between the rollers from leaving an impression on sensitive paper. The eccentricity of square shaft 34 relative to gear 33 is set so that leaf spring 36 is deflected moderately causing a feeding force from feed roller 20 on the paper being fed.

As shown in FIG. 4*c* when motor 30 is further rotated in the direction of arrow A, square shaft 34 is rotated in the direction indicated by arrow D. The eccentricity of square shaft 34 is determined to allow a greater deflection of leaf spring 36 by this further rotation Accordingly, the force applied on rotatable shaft 26 by leaf spring 36 becomes greater and the force applied by pressure roller 24 in the direction of arrow $F_2$ is greater than the force applied in the direction of arrow $F_1$, providing a satisfactory force for feeding paper between feed roller 20 and pressure roller 24.

Reference is now made to FIGS. 3*a*–3*d* wherein operation of the invention is illustrated. The pins of tractor 18 engage fan fold paper 7 to feed fan fold paper 7 in the direction of arrow K so that the leading edge of fan fold paper 7 is adjacent feed roller 20 as shown in FIG. 3*a*. At this stage, pressure roller 24 is separated from feed roller 20 and thus exerts no influence on fan fold paper 7.

Figure 3D:
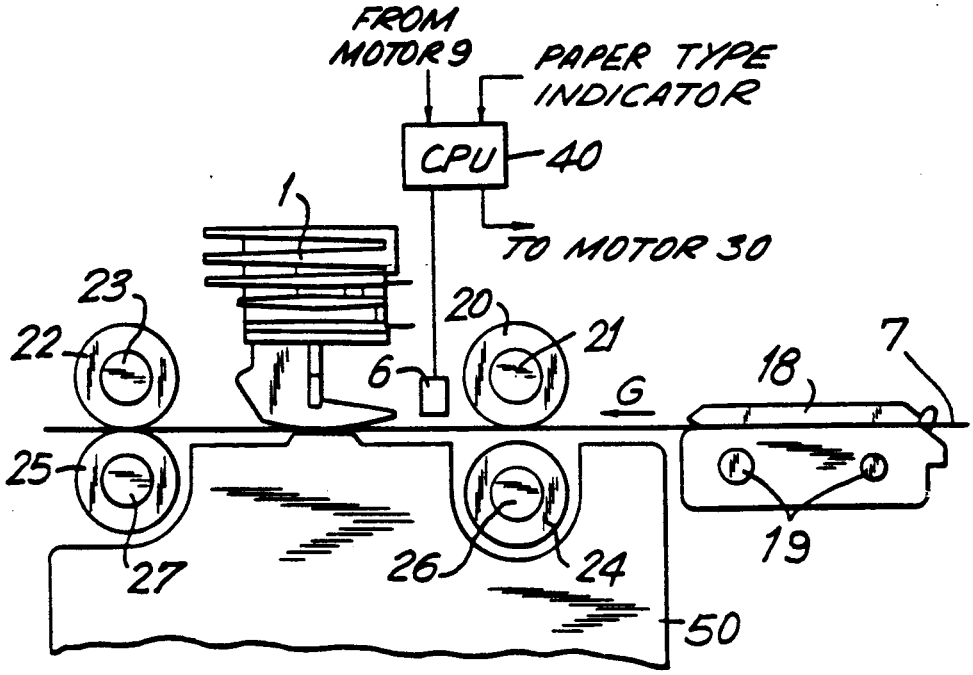

Fan fold !paper 7 continues to travel along the paper feed path in the direction of arrow K until the leading edge of fan fold paper 7 is detected by detector 6 positioned between feed rollers 20 and print head 1. Fan fold paper 7 has now traveled a distance $V_1$ between tractor 18 and a position at which detector 6 detects the leading edge of fan fold paper 7 as seen in FIG. 3*d*. This distance is substantially one half the distance $V_2$ corresponding to the distance between discharge roller 22 and push tractor 18. The distance $V_1$ is short enough so that all of the feeding force required to reach feed roller 20 may be supplied by tractor 18 and the stiffness of fan fold paper 7 will prevent the paper from becoming slack as it travels.

When the leading edge of fan fold paper 7 is detected by detector 6 motor 30 rotates to shift pressure roller 24 to apply a force $F_1$ as seen in FIG. 3*b*. Feed roller 20 provides a driving force to feed fan fold paper 7 by the pressure exerted on fan fold paper 7 by roller 20 and pressure roller 24. Fan fold paper 7 is now driven at two points along the paper path by feed roller 20 and push tractor 18. The stiffness of fan fold paper may now be used to prevent slack within fan fold paper 7 between the intermediate drive point represented by drive roller 20 and the end drive point at discharge roller 22. Accordingly, no slack occurs in fan fold paper 7 as it travels the distance $V_3$.

When paper is driven by drive roller 20, discharge roller 22 and push tractor 18, the driving force obtained by push tractor 18 is an additional driving force which is not required when driving cut sheet paper. Accordingly, due to this additional driving force applied by tractor 18, drive roller 20 need not exert such a great influence on fan fold paper being fed. Therefor, pressure roller 4 need push against feed roller 20 with only a moderate amount of pressure. This also allows for feeding of pressure sensitive fan fold paper 7.

The feed velocity of feed roller 20, $V_2$ and the feed velocity of push tractor 18, $V_1$, are set equal so that:

$$V_1 = V_2$$

Because feed roller 20 feeds fan fold paper at the same speed as push tractor 18, no deflections occur along the distance $V_2$ and deflections which occur while fan fold paper travels across the short distance $V_3$ may be neglected even where deflections are caused by differences in roller outer diameters, imperfections in part precision or the like.

When detector 6 detects the leading edge of fan fold paper 7 a CPU 40 on a control board (not shown) begins counting the feed rate of motor 9, which controls feeding of push tractor 18, to determine the position of the leading edge of fan fold paper 7 as it travels along the paper path. Once the CPU has calculated that the fan fold sheet 7 has passed between discharge roller 22 and pressure roller 25, motor 30 rotates to detach pressure roller 24 from feed roller 20 as shown in FIG. 3*d*.

Fan fold paper 7 is now fed by discharge roller 22, pressure roller 25 and push tractor 18. The velocity of discharge roller 22, $V_3$, is greater than push tractor velocity, $V_1$, and the relationship may be represented as:

$$V_3 > V_1$$

Therefor, fan fold sheet 7 is tensioned across distance $V_2$. However, the driving force of discharge roller 22 is proportionally small relative to the driving force of push tractor 18 so that fan fold paper 7 is primarily fed by the pins of tractor 18 when fan fold paper 7 is fed as shown in FIG. 3*d*. This insures high precision paper feeding.

Figure 3E:
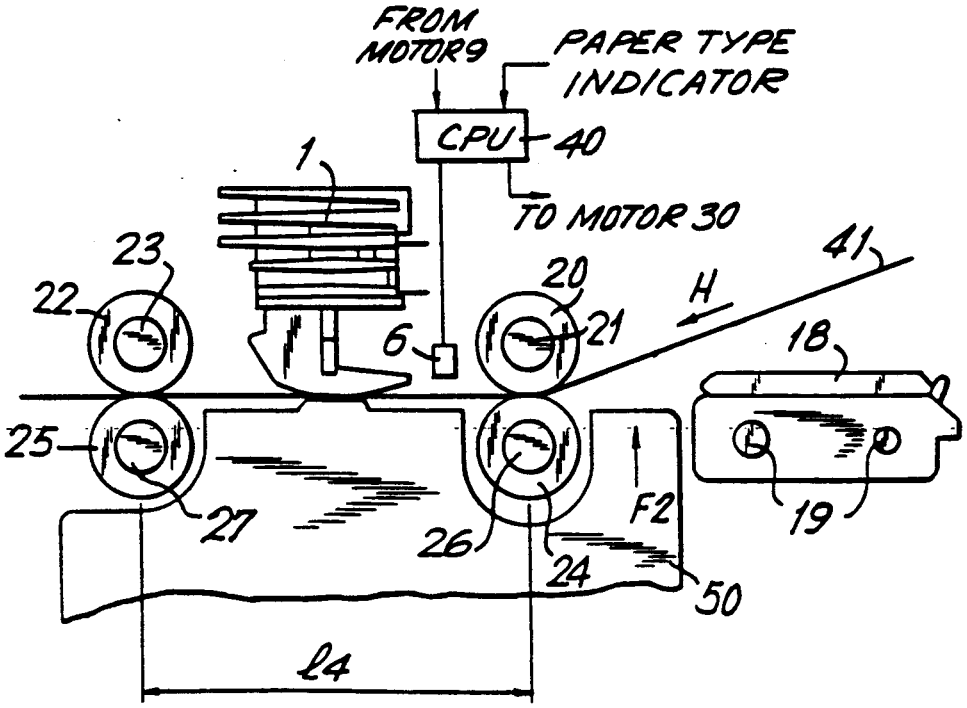

As discussed above, the feed force provided by push tractor 18 is additional to that of the feed force provided by feed roller 20. Accordingly, cut sheet 41 may be fed in the direction of arrow H without the use of push tractor 18 as shown in FIG. 3*e*. When feeding cut sheet 41, pressure roller 24 is maintained in contact with drive roller 20 by motor 30 with a force $F_2$ greater than force $F_1$, so that drive roller 20 may provide a large driving fore to cut sheet 41. This result is achieved by the CPU 40 positioning motor 30 in response to a paper type indication input.

The feed roller velocity, $V_2$ is still equal to push tractor velocity, $V_1$, and may be expressed as:

$$V_2 < V_1$$

Therefor, there is no difference in the feed rate between cut sheet and fan fold paper 7. Additionally, feed roller velocity, $V_2$, of feed roller 20 is less than discharge roller velocity, $V_3$, of discharge roller 22 so that:

$$V_2 < V_3$$

Again, a tension is provided so that cut sheet 41 is continuously tensioned across a distance $V_4$ between feed roller 20 and discharge roller 22. Due to the tensioning, no slack occurs in cut sheet 41 and the sheet may be fed with high precision.

In the above embodiment in which the pressure applied by drive roller 20 is controlled, a step motor has been used by way of example. However, a solenoid, magnetic clutch or the like may be used in place of the step motor.

By providing a paper feeding apparatus which includes a push tractor for feeding fan fold paper towards a print head and a first paper feeding roller intermediate the print head which may variably apply pressure to the fan fold paper and a second feeding roller downstream of the print head the slack which occurs in feeding fan fold paper may be eliminated providing a high precision paper feeding apparatus.

It will thus be seen that the objects set forth above, among those made apparent by the preceding description, are efficiently attained and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statement so the scope of the invention which, as a matter of language may be said to fall therebetween.

What is claimed is:

1. An apparatus for feeding paper in a printer adapted to utilize both fan fold paper and cut sheet paper comprising push tractor means for feeding fan fold paper, a print head positioned downstream along the paper path of said push tractor means, first paper feed means intermediate said push tractor means and said print head for selectively feeding paper along said paper path, and second paper feed means downstream of said print head along the paper path for feeding paper along said paper path, the first paper feeding means including at least one first feed roller rotatably mounted on the printer, a first pressure roller rotatably mounted on the printer selectively contacting the first feed roller, the paper being fed by the first paper feed means moving between the first feed roller and the first pressure roller; and pressure adjusting means for adjusting the pressure at which the first pressure roller contacts the first feed roller, the pressure adjusting means including a drive wheel, motor means for driving said drive wheel, a square shaft eccentrically positioned on said drive wheel, biasing means positioned for selectively coming in contact with said square shaft at selected positions of the drive wheel for biasing said first pressure roller towards said drive roller, whereby driving of the drive wheel causes the square shaft to cause the biasing means to bias said first pressure roller towards said first feed roller.

2. The apparatus for feeding paper of claim 1, further including means for controlling the engagement of the first paper feeding means so that fan fold paper is fed only by the push tractor means until a leading edge of the fan fold paper moves past the first paper feed means, the fan fold paper is fed by the push tractor means and the first paper feed means until the leading edge of the fan fold paper has passed the second paper feed means and disengaging said first paper feed means so that the fan fold paper is fed by the push tractor means and second paper feed means once the leading edge of the fan fold paper has passed the second paper feed means along the paper feed path.

3. The apparatus for feeding paper of claim 2, further comprising detector means for detecting when the leading edge of the fan fold paper has passed the first paper feed means.

4. The apparatus for feeding paper of claim 3, wherein the detector means produces an output indicating detection of the leading edge and the means for controlling engagement receiving the output from the detector means causes the first feed means to feed fan fold paper in response thereto.

5. The apparatus for feeding paper of claim 4, wherein the means for controlling engagement receives a paper type indication signal and in response thereto causes the first paper feed means to apply pressure to paper being fed by the first paper feed means, the force being applied by the first paper feed means when feeding fan fold paper being less than the force being applied when feeding a cut sheet.

6. The apparatus for feeding paper of claim 1, wherein the first paper feed means applies pressure to paper being fed by the first paper feed means, the force being applied by the first paper feed means when feeding fan fold paper is less than the force being applied when feeding a cut sheet.

7. The apparatus for feeding paper of claim 1, wherein the first paper feed means paper at a velocity equal to the velocity at which the push tractor means feeds fan fold paper and less than the velocity at which the second paper feed means feeds paper, thereby tensioning the paper being fed along a distance between the first paper feed means and the second paper feed means.

8. The apparatus for feeding paper of claim 1, wherein the second feed means comprises at least one second discharge roller rotatably mounted on the printer and a second pressure roller rotatably mounted on the printer, the second pressure roller contacting the second discharge roller, whereby the paper being fed travels between the second discharge roller and the second pressure roller.

9. The apparatus for feeding paper of claim 8, wherein the first paper feeding means includes at least one first feed roller rotatably mounted within the printer, a first pressure roller rotatably mounted within the printer selectively contacting the first feed roller, the paper being fed by the first paper feed means moving between the first feed roller and the first pressure roller and pressure adjusting means for adjusting the pressure at which the first pressure roller contacts the first feed roller.

10. The apparatus for feeding paper of claim 1, wherein the biasing means is a leaf spring.

11. The apparatus for feeding paper of claim 1, wherein the pressure adjusting means applies a greater pressure when the first paper feed means feeds fan fold then when the first paper feed means feeds cut sheet paper.

12. An apparatus for feeding paper in a printer adapted to utilize both fan fold paper and cut sheet paper comprising push tractor means for feeding fan fold paper, a print head positioned downstream along the paper path of said push tractor means, first paper feed means intermediate said push tractor means and said print head for selectively feeding paper along said paper path, and second paper feed means downstream of said print head along the paper path for feeding paper along said paper path, the first paper feeding means including at least one first feed roller rotatably mounted within the printer, a first pressure roller rotatably mounted within the printer selectively contacting the first feed roller, the paper being fed by the first paper feed means moving between the first feed roller and the first pressure roller and pressure adjusting means for adjusting the pressure at which the first pressure roller contacts the first feed roller, the pressure adjusting means including a gear train, motor means for driving said gear train, a square shaft eccentrically positioned on said gear train, biasing means selectively coming in contact with said square shaft for biasing said pressure roller towards said drive roller whereby driving of the gear train causes the square shaft to cause the biasing means to bias said pressure roller towards said feed roller.

13. The apparatus for feeding paper of claim 12, further including means for controlling the engagement of the first paper feed means so that fan fold paper is fed only by the push tractor means until a leading edge of the fan fold paper moves past the first paper feed means, the fan fold paper is fed by the push tractor means and the first paper feed means until the leading edge of the fan fold paper has passed the second paper feed means and disengaging said first paper feed means so that the fan fold paper is fed by the push tractor means and second paper feed means once the leading edge of the fan fold paper has passed the second paper feed means along the paper feed path.

14. The apparatus for feeding paper of claim 12, wherein the first paper feed means applies pressure to paper being fed by the first paper feed means, the force being applied by the first paper feed means when feeding fan fold paper is less than the force being applied when feeding a cut sheet.

15. The apparatus for feeding paper of claim 12, wherein the first paper feed means feeds paper at a velocity equal to the velocity at which the push tractor means feeds fan fold paper and less than the velocity at which the second paper feed means feeds paper, thereby tensioning the paper being fed along a distance between the first paper feed means and the second paper feed means.

* * * * *